United States Patent [19]

Delannoy

[11] Patent Number: 4,600,465

[45] Date of Patent: Jul. 15, 1986

[54] DEVICE FOR HANDLING ELONGATED WEBS

[75] Inventor: Robert G. Delannoy, Paris, France

[73] Assignee: Molinier S. A., France

[21] Appl. No.: 577,710

[22] Filed: Feb. 7, 1984

[30] Foreign Application Priority Data

Feb. 8, 1983 [FR] France ..... 83 02278

[51] Int. Cl.[4] ..... B32B 31/08; B32B 31/18; B32B 31/26

[52] U.S. Cl. ..... 156/351; 156/64; 156/157; 156/184; 156/250; 156/360; 156/378; 156/379; 156/443; 156/459; 156/494; 156/495; 156/499; 156/502; 156/505; 156/510; 242/55; 242/58.1

[58] Field of Search ..... 156/378, 443, 459, 494, 156/495, 502, 505, 510, 351, 360, 379, 499, 64, 157, 184, 250; 242/54 R, 55, 58.1, 60

[56] References Cited

U.S. PATENT DOCUMENTS 2,062,008 11/1936 Lewis et al. ..... 242/58.1
3,055,606 9/1962 Alden ..... 242/60
3,245,861 4/1966 Roshkind ..... 156/505

*Primary Examiner*—Caleb Weston
*Attorney, Agent, or Firm*—Eric P. Schellin

[57] ABSTRACT

An apparatus which successively and incontinuous action ensures the winding of bands from skeins, the retraction of the unwound bands, the drying of the retracted bands, and the winding by predetermined lengths, with checking of the quality of the possible variations of the lengths.

20 Claims, 14 Drawing Figures

FIG. 8
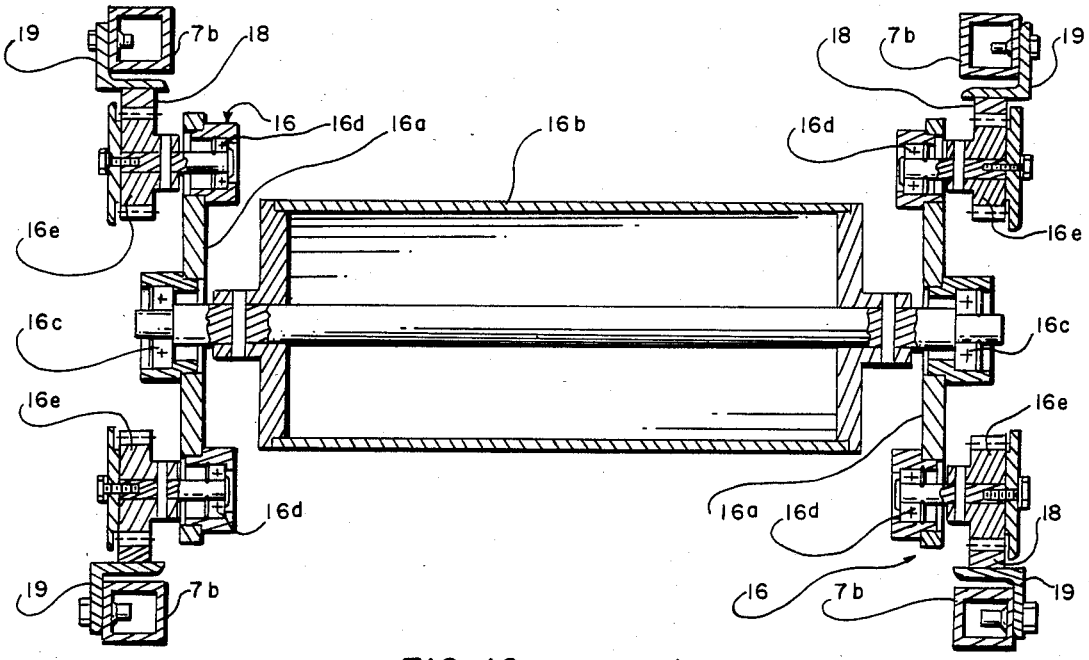
FIG. 10
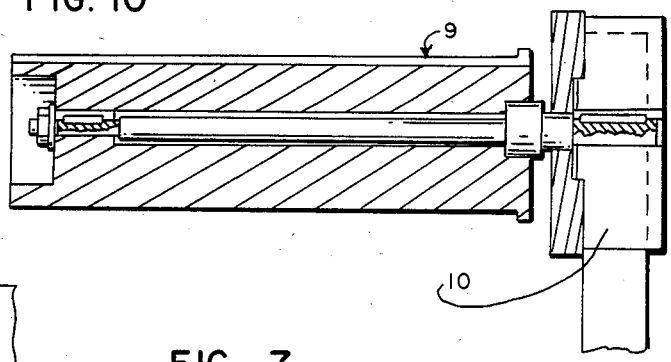
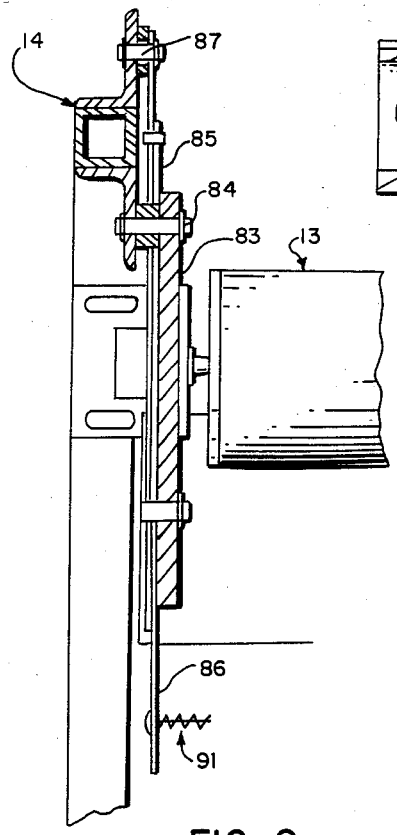
FIG. 9
FIG. 7
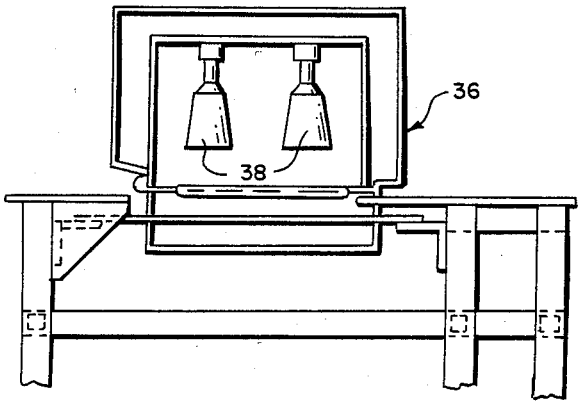

DEVICE FOR HANDLING ELONGATED WEBS

The invention relates to a machine for treating and preparing bands, more particularly surgical bands, after the manufacture of these bands.

The object of the invention pertains more particularly to the art units of the manipulation of band materials and of the treatment of textiles after manufacturing.

In accordance with the invention, there has been provided a machine which successively and in continuous action ensures the unwinding of the bands from skeins, the retraction of the unwound bands, the drying of the retracted bands, and the winding by pre-determined lengths, with checking of the quality of the possible variations of the lengths.

For this purpose, the machine in accordance with the invention is essentially comprised of a succession of stations in which the bands stored on skeins are unwound under steady tensioning by electromagnetic coupling devices associated with the drive motors, and with continuous hooking of the bands of different materials, the bands being then brought either to a means for retraction by steaming at reduced pressure through the intermediary of at least of one paying off device or magazine; or directly to a drying or retraction enclosure, the dried bands being then passed through a varying reserve of bands by alternate windings, prior to being wound up by pre-determined lengths with a steady checking of the quality, a steady checking and adjustment of the lengths, said stations including means for winding the bands and for discharging the completed reels or bobbins, and all these stations working in synchronism under the conduct of a control means of the programmable automatic device type.

These and other characteristics will be apparent from the following description.

To make the object of the invention more concrete, without however restricting it thereby, reference will be made to the attached schematic drawings, in which:

FIG. 7 is a sectional view along the line 7—7 of FIG. 6.

FIG. 8 is a sectional view, on a larger scale, along the line 8—8 of FIG. 3, showing the mounting of the band varying reserve device.

FIG. 9 is a partial sectional view along the line 9—9 of FIG. 3, illustrating a mounting detail of a connecting device for the unwound bands.

FIG. 10 is a sectional view along the line 10—10 of FIG. 3, showing the electromagnetic coupling device for the unwinding of the bands under steady tensioning.

The object of the invention, to be better understood, will be described now in a non limitative form of embodiment illustrated in the Figures of the drawings.

Figure 1:
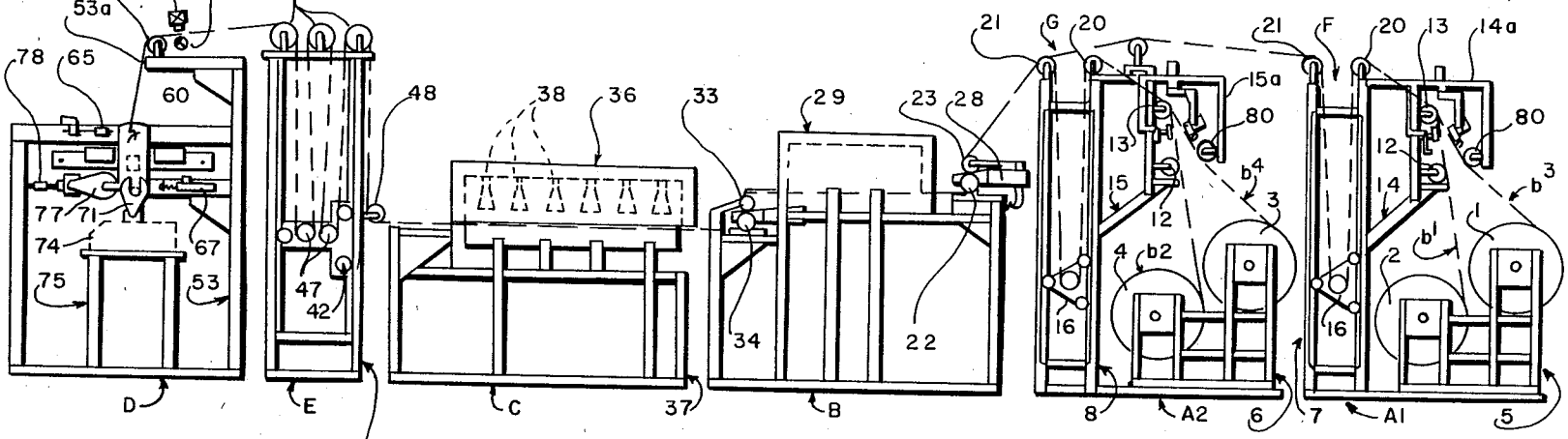
FIG. 1 is a front view illustrating the various working stations of the machine in accordance with the invention.
Figure 2:
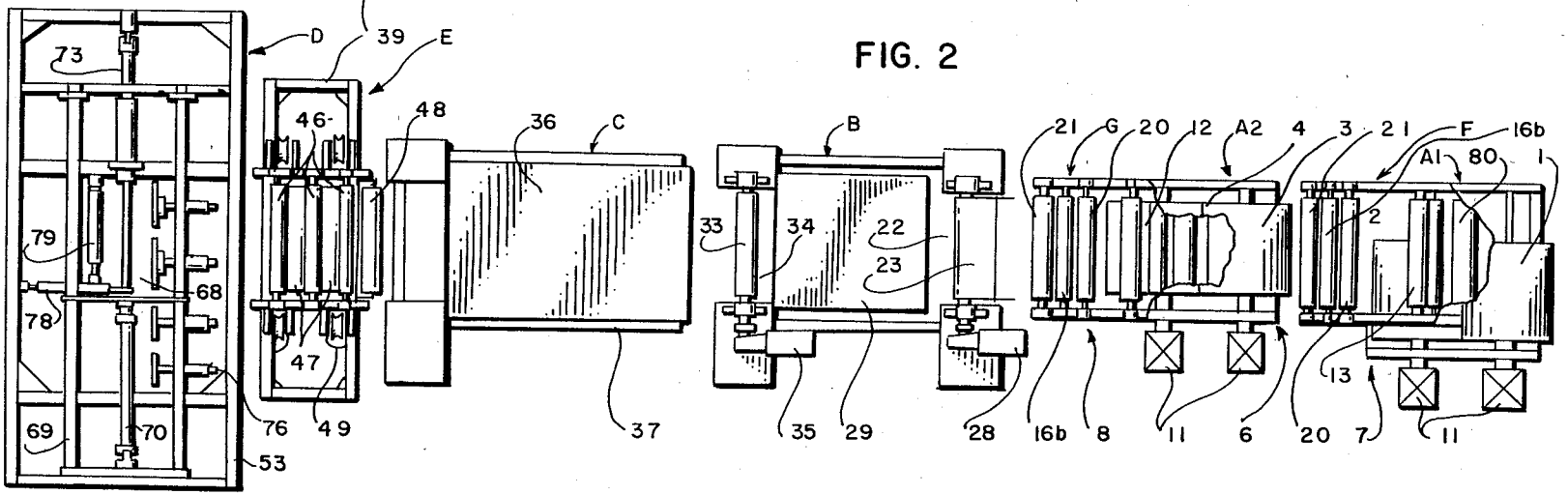
FIG. 2 is a plane view corresponding to FIG. 1.

As may be clearly seen in FIGS. 1 and 2, the machine according to the invention, in the non limitative example illustrated, includes two feeding stations (A1–A2), a retracting station (B), a drying station (C) and a winding station (D) which is separated from the station (C) by a band varying reserve device (E).

Two feeding stations (A1–A2) have been provided to supply simultaneously the retracting station with two coupled bands (b1–b2). For this purpose, as illustrated in FIG. 2, the skeins (1–2) mounted on the station (A1) are staggered transversely relative to the skeins (3–4) mounted on the station (A2). It would be possible of course to contemplate one feeding station only supplying a band of double width, or still to contemplate more than two bands by adapting, as the case may be, the width of the various stations for the passage of the bands therethrough.

A detailed description of the feeding stations (A1–A2) will be given now, more particularly with reference to FIGS. 1, 2, 3, 8, 9 and 10.

Each station consists of a mechano-welded framework including a rear supporting structure (5–6) for mounting the skeins, and a front supporting structure (7–8) for the paying off device or magazine (F–G). Both structures may be integral with one another, or independent from one another. Each skein is supported for free rotation by a support-pin (9) connected to a braking device of the powder electromagnetic coupling device type (10) in order to provide an unwinding under steady tensioning between the skein and its drive motor (11), shown diagrammatically at the end of the supportpin in FIG. 2.

The bands (b1–b2) wound on the skeins (2 and 4) are developed in succession on lower alignment rolls (12) and on upper alignment rolls (13) supported for free rotation by mechano-welded jibs (14–15) which are connected to the supporting structures (7–8). Thereafter, said bands are passed through the paying off device which comprises essentially a carriage (16) consisting of two triangular cheeks (**16*a*) interconnected axially by a drum (16*b*) mounted for free rotation on the cheeks by means of ball bearings (16*c***) or like organs.

Figure 3:
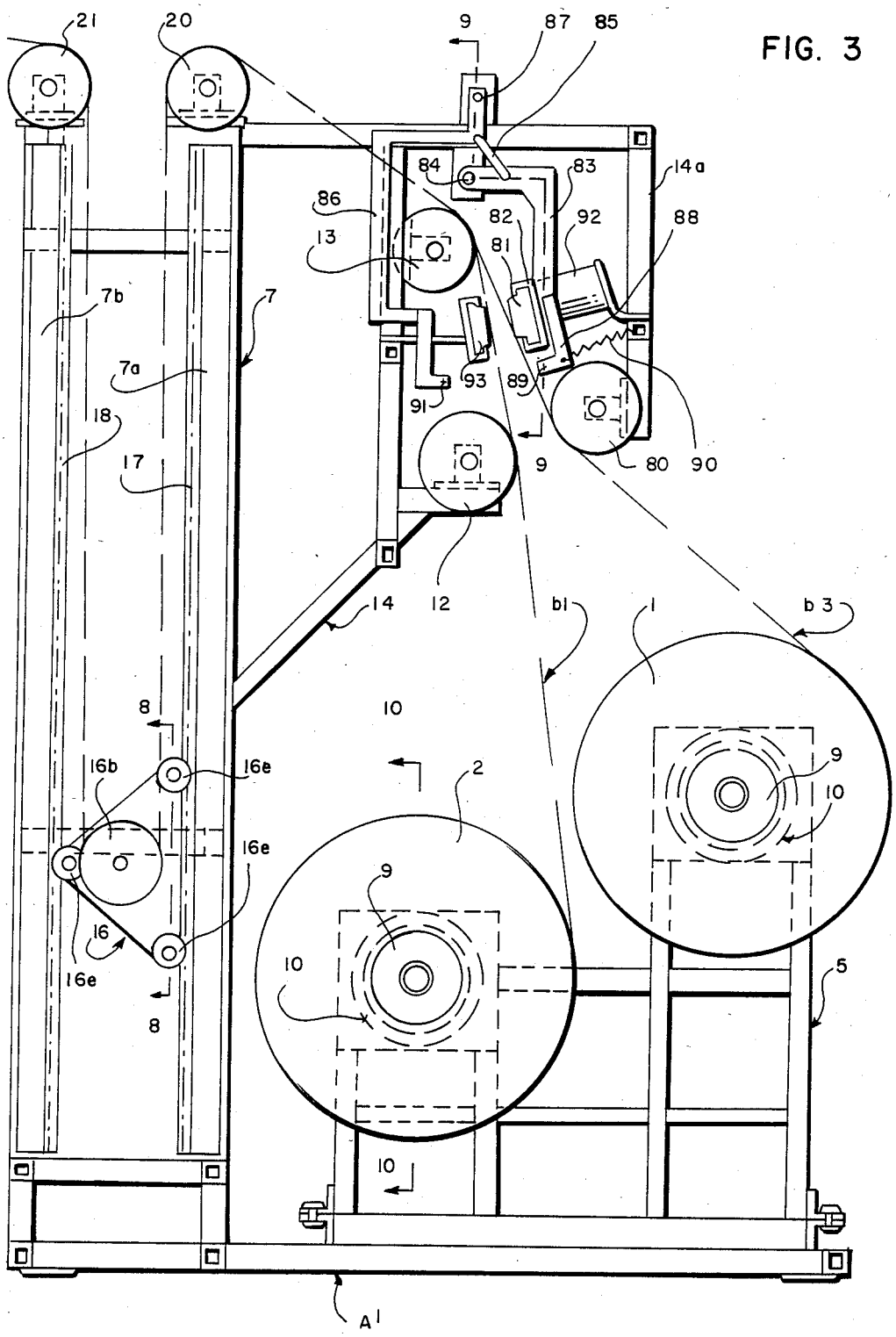
FIG. 3 is a front view on a larger scale, illustrating a band feeding or unwinding station in accordance with the invention.

At each apex, gears (**16*e*) are supported for free rotation by the cheeks, by means of ball bearings (16*d*) or the like. As best seen in FIGS. 3 and 8, the cheeks (16*a*) are so oriented that for each cheek, two gears will be meshed simultaneously with racks (17) supported by the rear posts (7*a* or 8*a*) of the front structure (7 or 8), while the third gears are meshed with opposite racks (18) supported by front posts (7*b* or 8*b*). It will be noted that in order to provide a correct running of the carriage by means of the gears and racks, the latter are mounted on the posts through the intermediary of squared contoured pieces (19**) which are adjustable relative to these posts.

The bands (B1–b2) which come from the upper roll or rolls (13) are wound on the drum (**16*b*) of the carriage, after being passed on an idler roll (20). After their winding on the drum (16***b*), the bands (b1–b2) go upward to be wound on another idler roll (21) and are directed toward the retracting station. The rolls (20–21) are respectively supported for free rotation at the top of the front and rear posts (7*a*–7*b*) or 8*a*–8*b*).

It will be appreciated that when a call of band becomes more important downwardly, or when the braking of the skeins is more important, the carriage will go upwardly into the magazine, reducing thus the stored loop. Conversely, when the braking or the call is reduced the carriage will go downwardly in the magazine, and will thus lengthen the loop. It will be noted that the braking or unbraking action of the coupling devices is controlled by a potentiometer which is actuated in dependence on the position of the carriage.

The bands (b1–b2) are then passed through the retracting station, the purpose of which is to make the bands extensible or to increase their elastical power. For this purpose, the bands are passed between a drive roll (22) and a pressure roller (23) supported by arms (24) linked hingedly at (25) on the posts of the framework (26) with elastic return springs (27). The roll (22) is connected to a gear-reducing unit with varying speed (28) for driving the bands which are passed thereafter horizontally across an insulating enclosure (29) equipped with nozzles (30) which distribute the steam without significant pressure (FIG. 4).

Figure 5:
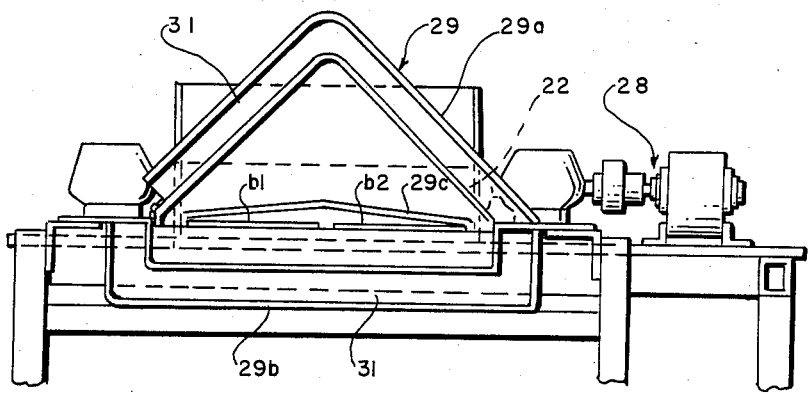
FIG. 5 is a partial sectional view along the line 5—5 of FIG. 4.

The enclosure (29) is formed by a cover (29*a*) with double slanting and by a base (29*b*) which is generally U-shaped. The two portions of the enclosure between which the bands are passed consist of a shell enclosing an insulating material (31), and the condensation drops (FIG. 5) are collected by chutes (29*c*) outside the path of the bands.

Figure 4:
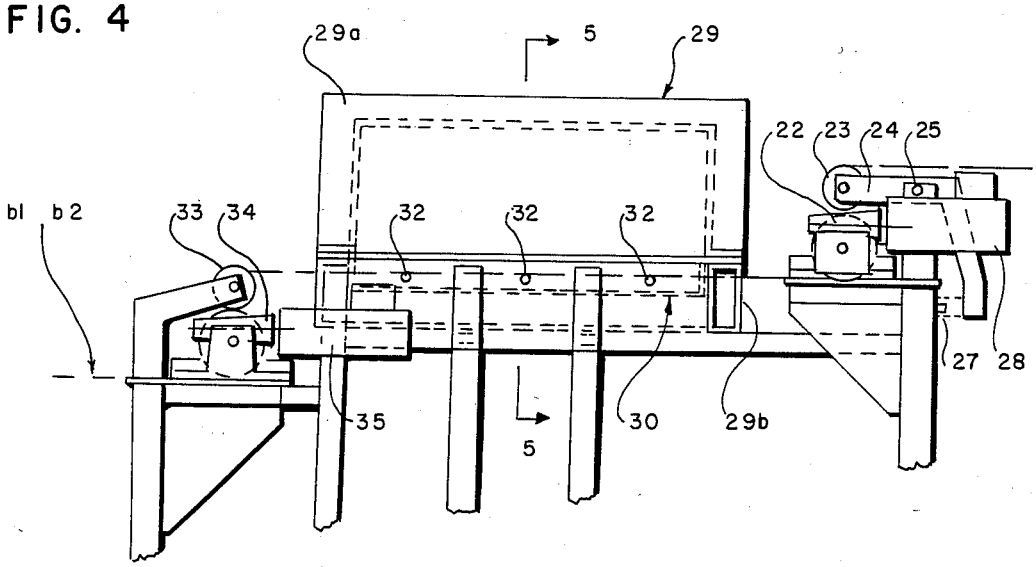
FIG. 4 is a partial front view, on a larger scale, showing the band retracting station in accordance with the invention.

It will be noted also that the bands are guided when crossing the steaming enclosure by sliding upon supportpins (32) disposed with regular spacing and mounted quite freely for rotation, so that the conditions of retraction of the bands will not be altered (FIG. 4).

At the exit from the enclosure, the retracted bands are wound upon a fixed idler roll (33) and round a drive roll (34) associated with a varying speed gear-reducing unit (35), for compensating the difference of length of the bands between the inlet and the outlet of the retracting station.

Figure 6:
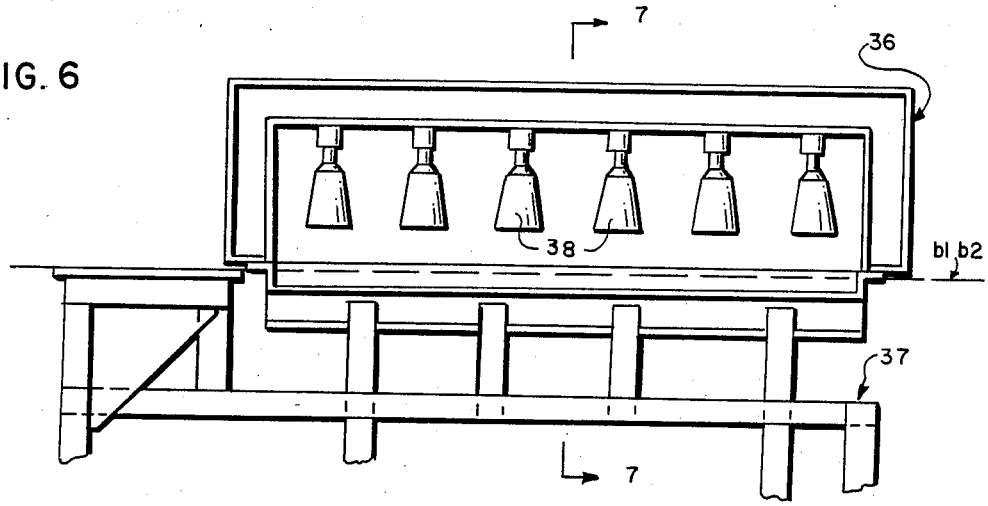
FIG. 6 is a partial longitudinal sectional view on a larger scale, illustrating the band drying station in accordance with the invention.
Figure 11:
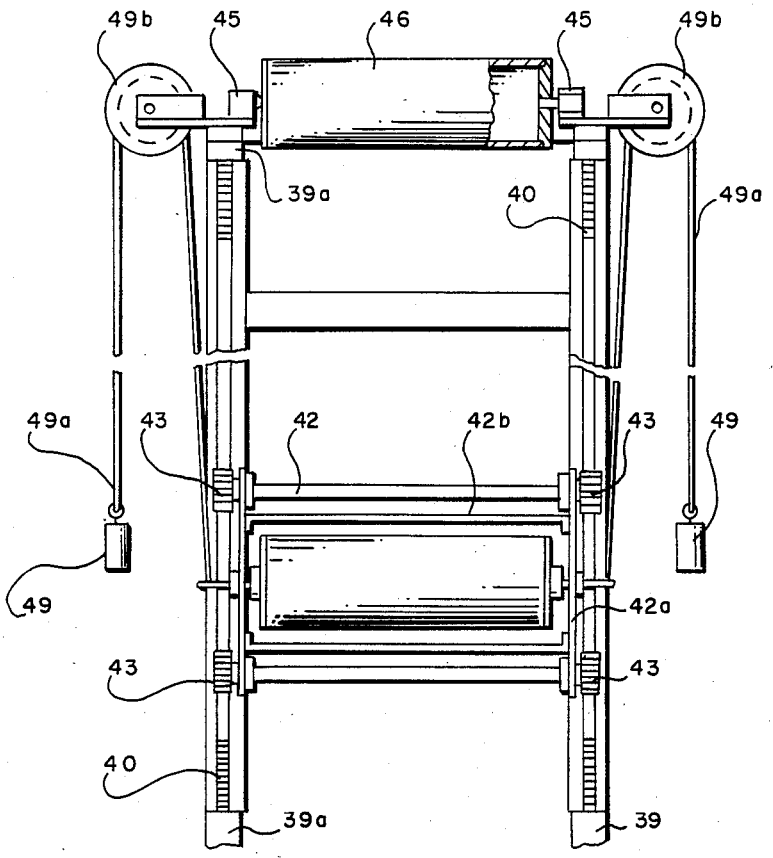
FIG. 11 is a side view of the band varying reserve device, with breaking off in the height.
Figure 12:
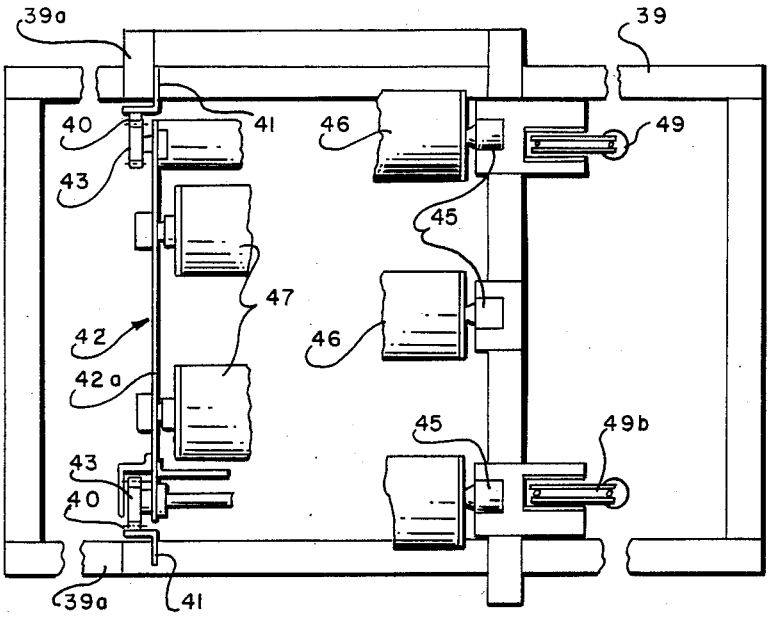
FIG. 12 is a plane view corresponding to FIG. 11, with breaking off in the height and illustration on two levels.

The bands (b1–b2) are then passed through the drying station (C) in order to suppress the moisture resulting from the steaming, and to complete the retraction, For this purpose, the bands are passed under an insulating enclosure or oven (36) supported by a framework (37) and equipped with infra-red lamps (38) or like means (FIGS. 6 and 7).

The dried bands (b1–b2) are then directed toward the winding station (D) by being passed previously through the varying reserve device (E), and as the case may be through a third drive gearing-unit disposed at oven outlet.

The band varying reserve device (E) illustrated in FIGS. 1, 2, 11 and 12, includes a framework (39) the four posts (39*a*) of which receive a rack (40) with adjustable positioning by means of squared contoured pieces (41). A carriage (42) consisting of two generally T-shaped cheeks (42*a*) braced at (42*b*) has along the ends of the three legs of the T the pinions (43) supported by support-pins (44) in order to mesh with the racks as per the arrangement illustrated in FIG. 1.

Idler rolls (46) are mounted at the top of the posts (39*a*) for free rotation by means of ball centering points (45), while other idler rollers (47) are also mounted for free rotation in the medial portion of the cheeks (42*a*). In the example illustrated, there are three upper rolls (46) and two lower rolls (47), however, it will be understood that this number could be different.

The bands (b1–b2) going out of the oven (36) are passed upon an idler roller (48) supported by the rear posts (39*a*), and then they are wound in succession round the upper rolls (46) and the lower rolls (47) prior to being directed toward the winding station (D).

The purpose of these alternate windings is to absorb substantial band lengths, and they assure the uninterrupted threading of the bands while the bands are cut and wound.

In order to lighten the weight of the carriage (42) and to prevent a distortion or a breaking of the bands, counterweights (49) have been conveniently adjusted and connected by flexible tie (49*a*) and pulleys (49*b*) to the cheeks of the carriage.

The carriage (42) is of course provided with a monitoring device controlling the speed of the gear-reducing unit (35) in order to slow down when the carriage is being lowered, and to accelerate when the carriage is being lifted, to compensate the leads or the delays detected downward, i.e. at the level of the preparation of the wound bands.

Prior to being introduced into the winding station (D), the bands (b1–b2) are passed under a picture camera (50) with a light (51) beneath these bands, the purpose of the camera being to check the quality of the bands (with memory storing of the location of the defect) and to detect the additions in the bands, in order to suppress them for the winding, as will be seen later.

Figure 13:
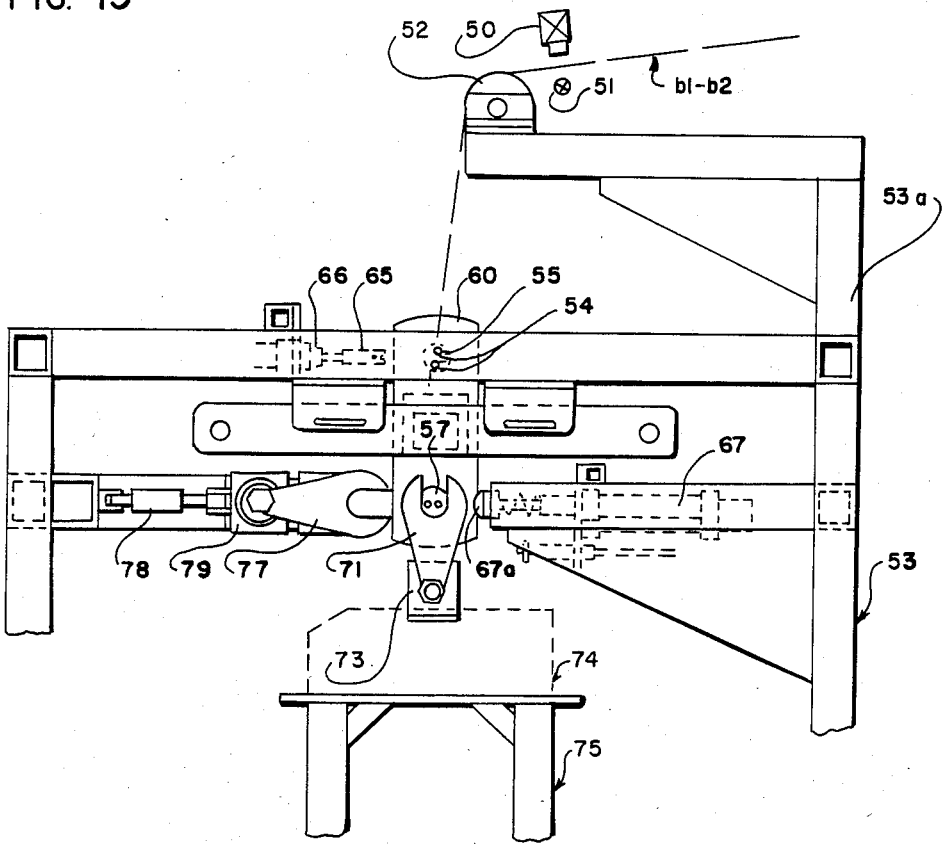
FIG. 13 is a front view on a larger scale of the winding station for the dried bands.
Figure 14:
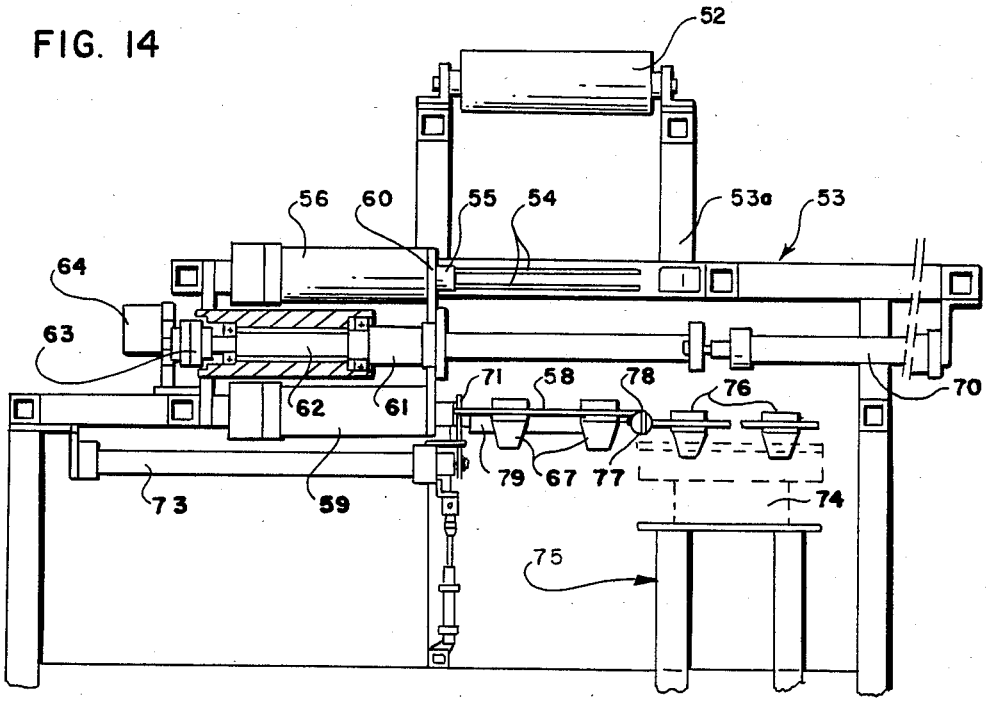
FIG. 14 is a sectional side view corresponding to FIG. 13.

After having been passed under the picture camera, the bands (b1–b2) are guided by an input roll (52) supported by a jib (53*a*) of the general framework (53) constituting the station (D), toward the winding means proper (FIGS. 13 and 14).

For this purpose, the ends of the bands are initially engaged between spaced pins (54) which are supported at the end of a spindle (55) associated with a brake-gearing-motor (56).

A further spindle (57), supporting two spaced pins (58), is also connected to a brake-gearing-motor (59). These two driving organs are supported in a diametrally opposed manner by a cheek (60) connected to a central pin (61) rotating within a casing (62) integral with the framework and connected by a coupling (63) to a rotational pressure cylinder (64) providing the rotations of the cheek in accordance with a half-turn.

When the device has been started, the upper spindle (55) is driven rotationally on itself, in order to carry out the winding, and the rotational pressure cylinder (64) is actuated at the same time to cause the cheek (60) to be rotated along a half-turn, in order to bring the spindle (57), and therefore the pins (58), in the upper position, to make the next reel or bobbin.

During this time, the first reel or bobbin continues to form itself on the pins (54). When the bobbin is practically completed, the spindle (55) is stopped (by means of the brake) with the pins (54) relocated above one another, and a blade (65) supported at the end of a pressure cylinder (66) integral with the framework (dash and dot lines, FIG. 13) is moved forward to be engaged with the bands in the pins (58), until the loops thus formed have moved past said pins. At the same time, lamination pressure cylinders (67) in the forme of an elastical abutment (67*a*) are advanced against the bobbins formed on the spindle (55). With the blade (65) being stopped in the advanced position, a pneumatic knife (68) of the type in the form of a disk cut in facets, guided on columns (69), is urged by a central pressure cylinder (70) in order to cut the bands (dash and dot lines, FIG. 2). After the cutting, the blade (65) is actuated again for the complete engagement of the ends of the bands cut in the pins (58).

The spindle (57) is then driven rotationally for effecting the second reeling or winding, while the spindle (55) is also driven to complete the winding of the end of the cut bands. Thereafter, the lamination pressure cylinders (67) are moved backward and a pallet (71) is engaged by a hinged pressure cylinder (72), rearwardly of the completed reels or bobbins, in order to discharge them by the action of a further pressure cylinder (73) to an electronic balance (74) secured on an independent frame (75) in order to avoid the vibrations.

The length of the reeled or wound bands is ascertained on the balance by weighing calculated as a function of their known density. If the weight does not correspond, an amendment is effected automatically by means of a photo-cell (not shown) cooperating with a toothed disk so that the count of the teeth will be modified by the cell.

In the case of defects detected by the picture camera, the detected bobbin or bobbins are discharged laterally out of the balance by means of pressure cylinders (76) in the form of abutment, while the correct bobbins are discharged toward a packaging means, by a pallet (77) engaged behind said bobbins while they are placed on the balance, the engagement being provided by a hinged pressure cylinder (78) and a thrust pressure cylinder (79).

To provide the continuous unwinding of the bands, the end of the bands (b1–b2) unwound from the skeins (2 and 4) must be hooked automatically with the beginning of the bands (b3–b4) wound upon the skeins (1 and 3), in order to have always two skeins in waiting.

For this purpose, and as illustrated in FIG. 3, a device is used which is supported by the jib (14 or 15) integral with the posts (7*a* or 8*a*) of the magazines or paying off devices, the alignment rolls (12–13) of the bands (b1–b2) being mounted for free rotation on this jib, as explained hereinbefore.

The jib is extended by a support (14*a* or 15*a*) the lower end of which supports an alignment roll (80) for the bands (b3–b4) paid off from the skeins (1 and 3), so that said bands will affix their free ends, provided with a double face adhesive, on a piece having a hooking surface (81) of the sealskin type, for instance, which for this purpose may be pulled sidewise relative to the support-guide (82) thereof, carried by an arm (83) linked hingedly at (84) to the jib.

The arm (83) is also connected by a small connecting rod (85) to a further arm (86) developing itself behind the alignment roll (13) which is linked hingedly at (87) to the jib.

Moreover, the arm (83) supports behind the support-guide (82) a support-element (88) for a resistance (89); the arm (83) support (88) assembly being returned in the rearward position by a return spring (90) secured to the extension (14*a* or 15*a*).

Likewise, the lower end of the arm (86) supports a resistance (91), and both resistances are intended for acting alternately in order to cut skein end bands, after hooking of the unwound bands of the new skeins. For this purpose, there is placed behind the hooking piece (81) an electromagnet (92) or other similar urging means, secured to the extension (14*a* or 15*a*).

It will be appreciated that when the skeins (2 and 4) are almost empty, the electromagnet (92) is actuated to urge the hooking piece (81) against a piece (93) with roughened surface which is mounted fixedly rearwardly of the bands (b1–b2), within the same alignment, but with the possibility of lateral shifting in the guide thereof.

During this action which takes place when the bands (b1–b2) are unwound further on, the second face of the adhesive provides the bonding of the bands (b3–b4) in waiting, while the arm (86), which is brought back against the bands (b1–b2) due to the effect of the arm and small connecting rod linkings, permits the resistance (91), which is energized, to cut the bands (b1–b2) rearwardly of the bonding.

Conversely, when it is desired to connect continuously fresh bands (b1–b2) to band ends (b3–b4), the hooking piece (93) is pulled laterally to affix thereto the ends of the bands (b3–b4) provided with double face adhesives, and then the hooking piece is reset in the waiting position. When the skeins (1 and 3) are almost empty, the electromagnet (92) is actuated for bonding the ends of the bands (b3–b4) on the bands (b1–b2), and then the bands (b3–b4) are cut rearwardly of the bonding by the resistance (89), which is the only one being energized.

It will be understood that all the bonding, cutting, unwinding adjustment operations etc.. are piloted in any known manner, and more particularly by means of an automatic device which can be programmed.

The advantages will be apparent from the description, and the following ones will be more particularly pointed out:

the efficiency of such a machine, which provides in a continuous manner the unwinding, the retraction, the drying and the reeling or winding of the textile bands, while checking the quality and the wound lengths by ascertaining the weight.

The invention is not restricted in any way to the use nor to the form of embodiment of the various parts thereof which have been more particularly described, and any alternative form of embodiment remains within the spirit and the scope of the invention.

I claim:

1. A machine for treating surgical bands after manufacture comprising a succession of stations (A1, A2, B, C, E, D,) along which bands (b1, b2, b3, b4) stored on skeins, (1,2,3,4) are unwound under steady tensioning by powder electromagnetic coupling devices, and associated drive motors (11) for the skeins which are connected in a continuous manner to the changes of said skeins by bonding devices having double face adhesive means disposed between said skeins, magazines (F, G) for discharging the bands to a retraction device under reduced tensioning and by steaming enclosure means (29) or directly to a drying or retraction enclosure (36), whereby the dried bands are passed through a band varying reserve (E) by alternate windings prior to being wound in pre-determined lengths and in a continuous manner in a winding station (D), and means for checking the quality and checking and adjustment of the wound lengths; the retraction means, winding means and drying means of the machine being operated in synchronism under the control means of a programmable automatic device, based upon the weight of band lengths wound.

2. A machine as claimed in claim 1, characterized in that the band feeding stations or station (A1, A2) consist of rearward supporting structures (5, 6) for mounting the skeins (1, 2, 3, 4) on their support-pins (9) associated with the coupling devices (10), and of front supporting structure (7, 8) for magazine devices (F, G) with jibs (14, 15) oriented in the direction of the skeins and supporting the means for the continuous connection of the bands.

3. A machine as claimed in claims 1 or 2 characterized in that magazines (F, G) consist of a carriage (16) cooperating by means of pinions (16*e*) mounted for free rotation at the ends of said carriage with racks (17) made fast in an adjustable manner with the posts of said magazines, a rotary drum (16*b*) mounted between cheeks (16*a*) of said carriage ensuring winding of bands coming from skeins and directed toward the retraction station, through the intermediary of idler rolls (20, 21) supported for free rotation at the top of said magazines, and a potentiometer associated with each carriage actuating each coupling device (10), in accordance with the position of the carriage, in order to adjust the braking of the skeins.

4. A machine as claimed in claims 1 or 2 characterized in that the change over of skeins or continuous connection of the bands by means of double face adhesive is provided by a device comprising a fixed piece (93) with roughened surface disposed rearwardly of the bands (b1, b2) unwound from the skeins (2, 4) and between the alignment rolls (12, 13) supported by jibs (14, 15) and a movable piece (81) with roughened surface, disposed in front of the bands (b1–b2), approximately in the same alignment and above an alignment roll (80), both pieces being movable laterally in order to affix thereto, without stopping the unwinding, the bands in waiting (b3, B4) with their double face adhesives, an electromagnet (92) urging organ being controlled to bring the end of the waiting band against the band being unwound to effect the bonding, and a resistance (89) or (91) energized tu cut rearwardly of the bonding bands coming from the unwound skeins.

5. A machine as claimed in claim 4, characterized in that movable piece (81) with roughened surface and resistance (89) are supported by an arm (83) linked hingedly to jibs (14, 15) and connected by a small connecting rod (85) to another arm (86) also linked hingedly to the jib, and supporting resistance (91), said electromagnet (92) is actuated to bring said movable piece (81) against the bands being threaded in front of the opposite piece (93), to move the two arms simultaneously toward one another so that the resistance which is to cut is energized, and a spring (90) returns arm (83) to the inactive position.

6. A machine as claimed in claim 1, characterized in that the band retraction device consists of steaming enclosure means (29) formed by a cover (29*a*) with double slanting and by a generally U-shaped base (29*b*), the two portions of the enclosure between which the bands are passed being constituted by an insulating material contained within a casing (31) which is proved internally with chutes (29*c*) for receiving the condensation droplets produced by the water steam distributed without noticeable pressure by the nozzles (30).

7. A machine as claimed in claim 6, characterized in that the bands are guided across steaming enclosure means (29) by sliding on support-pins (32) mounted quite free for rotation and in a regularly spaced manner within the enclosure, so that the retraction conditions will not be altered.

8. A machine as claimed in claims 1, 6 or 7, characterized in that before and after passage through the retraction device, the bands are driven between drive rolls (22, 35) connected to variable speed gear motor units (28, 35) associated with pressure rollers (23, 33) positioned fixedly or returned elastically.

9. A machine as claimed in claim 1, characterized in that the drying enclosure (36) for suppressing the moisture resulting from the steaming and for completing the retraction consists of an oven with insulating walls, supported by a framework (37) and provided with heating means of the infra-red lamp type (38).

10. A machine as claimed in claim 1, characterized in that the band varying reserve (E) consists of a framework (39) the four posts (39*a*) of which receive in an adjustable manner the racks (40) on which the pinions (43) roll meshingly, said pinions being mounted for free rotation at the ends of the cheeks (42*a*) of a conveniently braced carriage (42), the cheeks (42*a*) supporting for free rotation, between the pinions, the idler rolls (47) which, in combination with other idler rolls (46) mounted on ball points (45) at the top of the posts, constitute alternate winding means for the bands, said winding means being capable of accommodating substantial lengths of bands and of ensuring a continuous unwinding while the bands are being cut and reeled or wound up on bobbins.

11. A machine as claimed in claim 10, characterized in that the carriage (42) is provided with lightening counterweights (49) supported by flexible ties (49*a*) wound around pulleys (49*b*) and secured to the he ties (42*a*) of the carriage.

12. A machine in accordance with claim 10 characterized in that carriage (42) is provided with a monitoring device controlling the reducing gear unit (35), to slow down the speed when the carriage is lowered, or accelerate the speed when the carriage is moving upward, in order to compensate the leads or the delays detected downward at the level of band packaging.

13. A machine as claimed in claim 1, characterized in that the reeling or winding station (D) includes two spindles (55, 57) provided each one with two spaced pins (54, 58) for the winding of the bands, the spindles being connected to a brake-gear-motor (56, 59) and supported in a diametrically opposed manner by a cheek (60) fastened to a central pin (61) rotating within a casing (62) integral with the framework and connected by a coupling (63) to a rotary pressure cylinder (64) providing the rotations of the cheek along a half-turn.

14. A machine as claimed in claim 13 characterized in that a blade (65) is urged by pressure cylinder (66) for engaging the bands between the winding pins (54, 58) placed in the upper position with spindle stopped, while the reeling or winding on the pins (54, 58) placed in the lower position is completed, and lamination pressure cylinders (67) in the form of elastical abutment (67*a*) are advanced against the reels or bobbins.

15. A machine as claimed in claim 14 characterized in that the bands wound on the pins (54, 58) are cut in pre-determined lengths by pneumatic knife (68) with a blade in the form of a facet disk, which is guided on columns (69) and urged by a central pressure cylinder (70), the blade (65) being held in an advanced position during cutting, and terminating its stroke after cutting to complete the engagement of the cut end of the bands between pins (54, 58).

16. A machine as claimed in claim 15 characterized by the completion of reels or bobbins upon pins (54, 58) in the lower position, a pallet (71) is engaged by a pressure cylinder (72) linked hingedly to the framework, rearwardly of the reels or bobbins to discharge the latter by action of further pressure cylinder (73).

17. A machine as claimed in claim 16 characterized in that the completed reels or bobbins discharged by the pressure cylinder (73) are placed upon an electronic balance (74) secured to an independent frame (75), the length of wound band being measured as a function of the density by the balance, by weighing out said band; and adjustment of said length being provided by means of an electric photocell, associated with a toothed disk.

18. A machine as claimed in claim 17 characterized in that the bands coming from varying reserve device (E) and entering the reeling or winding station (D) by passing an input roll (52) are passed above a light source (51) and under a picture camera (50), the latter being provided to check the quality of the bands with storing of the location of the possible defects and detection of the band addition or bondings, to eliminate them at the time of cutting.

19. A machine as claimed in claim 18 characterized in that the reels or bobbins found to be correct by said picture camera are discharged toward the packaging means by a pallet (77) controlled to be passed rearwardly of the reels or bobbins by means of a linked pressure cylinder (78) and pushing pressure cylinder (79).

20. A machine as claimed in claim 18 characterized in that the reels or bobbins found to be faulty by said picture camera are discharged laterally from the balance by means of discharge pressure cylinders (76) in the form of an abutment against the reels or bobbins.

* * * * *